US008671500B2

(12) United States Patent
Carlson et al.

(10) Patent No.: US 8,671,500 B2
(45) Date of Patent: Mar. 18, 2014

(54) GRILL TOOL, ASSOCIATED PAD, AND ASSOCIATED METHODS

(75) Inventors: Brian P. Carlson, St. Paul, MN (US); Scott R. Limback, St. Paul, MN (US); Christine M. Rock, Greensboro, NC (US); Joseph P. Kaper, Bermuda Run, NC (US)

(73) Assignee: Ecolab USA, Inc., St. Paul, MN (US)

( * ) Notice: Subject to any disclaimer, the term of this patent is extended or adjusted under 35 U.S.C. 154(b) by 1379 days.

(21) Appl. No.: 12/420,479

(22) Filed: Apr. 8, 2009

(65) Prior Publication Data

US 2009/0255075 A1 Oct. 15, 2009

Related U.S. Application Data

(60) Provisional application No. 61/044,454, filed on Apr. 11, 2008.

(51) Int. Cl.
*A47L 13/10* (2006.01)

(52) U.S. Cl.
USPC ..... 15/229.11; 15/228; 15/209.1

(58) Field of Classification Search
USPC ..... 15/228, 209.1, 229.11
See application file for complete search history.

(56) References Cited

U.S. PATENT DOCUMENTS

| | | | | | |
|---|---|---|---|---|---|
| 2,657,413 | A | * | 11/1953 | Murdock | 15/229.11 |
| 3,412,416 | A | | 11/1968 | Simon | |
| 4,023,312 | A | | 5/1977 | Stickney | |
| D300,478 | S | | 3/1989 | Hoyt | |
| 4,828,427 | A | | 5/1989 | Nisenbaum | |
| 5,025,596 | A | | 6/1991 | Heyer et al. | |
| 5,054,830 | A | | 10/1991 | Nisenbaum | |
| 5,060,343 | A | | 10/1991 | Nisenbaum | |
| 5,134,746 | A | * | 8/1992 | William | 15/227 |
| 5,165,144 | A | | 11/1992 | Nisenbaum | |
| 5,373,600 | A | | 12/1994 | Stojanovski et al. | |
| 5,471,700 | A | | 12/1995 | Pereira | |
| D365,897 | S | | 1/1996 | Pereira | |
| 5,626,512 | A | | 5/1997 | Palaikis et al. | |

(Continued)

FOREIGN PATENT DOCUMENTS

| | | |
|---|---|---|
| JP | 2000-041934 | 2/2000 |
| JP | 2003-310515 | 11/2003 |

OTHER PUBLICATIONS

613 Clamshell Grill Scraper, date unknown, Prince Castle, Inc. Worldwide, IL, USA.

(Continued)

*Primary Examiner* — Lee D Wilson
*Assistant Examiner* — Shantese McDonald
(74) *Attorney, Agent, or Firm* — Andrew D. Sorensen; Shaoni L. Mitchell

(57) ABSTRACT

A grill tool, a pad usable with the grill tool, and a method of making and using the grill tool are disclosed. Such a grill tool is configured for cleaning a surface while maintaining the surface at a temperature up to the operating temperature of the surface. The grill tool includes a tool head and a tool handle. The tool head includes an attachment mechanism for removably attaching a cleaning pad to the head so as to present a major cleaning surface and opposite minor cleaning surfaces. The tool handle may be configured to include handles capable of maintaining a user's hands horizontally and vertically spaced apart along the handle.

10 Claims, 11 Drawing Sheets

(56) References Cited

U.S. PATENT DOCUMENTS

| | | | | |
|---|---|---|---|---|
| D384,566 | S | 10/1997 | Dickhaus | |
| 5,685,935 | A | 11/1997 | Heyer et al. | |
| 5,765,256 | A | 6/1998 | Allan et al. | |
| D410,308 | S | 5/1999 | Tintelnot | |
| D420,183 | S | 2/2000 | Tintelnot | |
| 6,065,178 | A | 5/2000 | Hsieh | |
| 6,141,813 | A | 11/2000 | De Guzman | |
| 6,216,306 | B1 | 4/2001 | Esterson et al. | |
| D457,698 | S | 5/2002 | Susani | |
| D462,150 | S | 8/2002 | Rader et al. | |
| D473,027 | S | 4/2003 | Pecaut | |
| 6,571,419 | B1 | 6/2003 | Lee | |
| D480,852 | S | 10/2003 | Farce | |
| 6,760,949 | B2 | 7/2004 | Kaminstein et al. | |
| 6,871,377 | B2 | 3/2005 | Veltrop et al. | |
| D506,587 | S | 6/2005 | Armaly, Jr. | |
| 6,916,382 | B1 | 7/2005 | Aldredge | |
| 6,966,094 | B1 | 11/2005 | Rigakos | |
| D521,200 | S | 5/2006 | Veltrop et al. | |
| D523,198 | S * | 6/2006 | Veltrop et al. | D32/49 |
| D523,601 | S | 6/2006 | Veltrop et al. | |
| 7,082,941 | B2 | 8/2006 | Jones et al. | |
| 7,150,063 | B1 | 12/2006 | Graham | |
| D548,414 | S | 8/2007 | Akin et al. | |
| D556,966 | S | 12/2007 | Herbrand et al. | |
| 2006/0201495 | A1 | 9/2006 | Jones et al. | |
| 2006/0207042 | A1 | 9/2006 | Di Paolo | |
| 2007/0130713 | A1 * | 6/2007 | Chen et al. | 15/209.1 |
| 2007/0251518 | A1 | 11/2007 | Calzada et al. | |
| 2007/0254078 | A1 | 11/2007 | Calzada et al. | |
| 2007/0270088 | A1 | 11/2007 | Greenwood | |
| 2008/0139711 | A1 | 6/2008 | Borade et al. | |
| 2009/0199868 | A1 * | 8/2009 | Cybulski et al. | 134/6 |

OTHER PUBLICATIONS

Bear-Tex Surface Finishing Products, Hand Pads 325, date unknown, pp. 106-131, web site, www.nortonabrasives.com, Norton.
Carlson et al., U.S. Appl. No. 29/306,624, filed Apr. 11, 2008.
Carlson et al., U.S. Appl. No. 29/306,625, filed Apr. 11, 2008.
Chemical Resistance of Vydyne® Polyamide 66 Resins, technotes, copyright Mar. 2007, Solutia, Inc.
David Cowen and David Zabrowski, AccuTemp Accu-Steam EG2083A36 Electric Griddle Performance Test, Application of ASTM Standard Test Method F 1275-03, FSTC Report 5011.05.18, Food Service Technology Center, copyright 2005, Pacific Gas and Electric Company.
David Cowen and David Zabrowski, Blodgett B36N-TTT Gas Griddle Performance Test, Application of ASTM Standard Test Method F 1275-03, FSTC Report 5011.04.02, Food Service Technology Center, copyright 2004, Pacific Gas and Electric Company.
David Cowen and David Zabrowski, Garland CG-36R Gas Griddle Performance Test, Application of ASTM Standard Test Method F 1275-99, FSTC Report 5011.02.05, Food Service Technology Center, copyright 2002, Fisher-Nickel, Inc.
David Cowen and David Zabrowski, Garland Xpress XG-24 Double-Sided Griddle Performance Test, Application of ASTM Standard Test Method F 1605-95 (2007), FSTC Report 5011.07.20, Food Service Technology Center, copyright 2007, Pacific Gas and Electric Company.
David Cowen and David Zabrowski, Jade JGTSD Gas Griddle Performance Test, Application of ASTM Standard Test Method F 1275-99, FSTC Report 5011.03.18, Food Service Technology Center, copyright 2003, Fisher-Nickel, Inc.
Food Service Technology Center Appliance Test Summary Report, Garland Xpress XG24 2-foot double-sided gas griddle, Report No. 5012.08.24, copyright 2008, Fisher-Nickel, Inc.
Food Service Technology Center Appliance Test Summary Report, Garland Xpress XE24 2-foot double-sided electric griddle, Report No. 5012.08.23, copyright 2008, Fisher-Nickel, Inc.
H&K International Restaurant Equipment Systems Worldwide, brochure, copyright May 2009, web site, http://www.hki.com/brochures.
H&K Norwood Chapter 4, Grill Area, date unknown, pp. 4-1-4-60.
Ides Prospector, Pro-fax 8523 LyondellBasell Industries—Polypropylene Impact Copolymer, copyright Apr. 2009.
Ides Prospector, Vydyne® 21 SPF (Cond), Solutia, Inc.—Polyamide 66 datasheet, copyright Apr. 2009, IDES.
Ides Prospector, Vydyne® 21 SPF (Dry), Solutia, Inc.—Polyamide 66 datasheet, copyright Apr. 2009, IDES.
Moisture Conditioning of Vydyne® Polyamide 66 Resins, technotes, copyright Mar. 2007, Solutia, Inc.
Pro-fax 8523, Polypropylene, Impact Copolymer, copyright Aug. 2008, Lyondell Basell.
Pro-fax 8523. Product Data and Technical Information, copyright 2007, Lyondell Basell.
Scotch-Brite Cleaning Products Catalog, copyright 2004, 3M Commercial Care Division, USA.
Tests for Flammability of Plastic Materials for Parts in Devices and Appliances, UL 94, copyright Apr. 2009, web site, http://ulstandardsinfonet.ul.com/scopes/0094.html.
UL94 Explained, UL Flame Rating—UL94, copyright Apr. 2009, web site, http://www.ides.com/property_descriptions/UL94.asp.
UL94 General Information, Fire Testing Technology Limited, copyright Apr. 2009, web site, http://www.fire-testing.com/html/instruments/ul94ad.htm.
Vydyne 21SPF/21SPG data sheet, Natural and Black general purpose high productivity, copyright 2008, Solutia, Inc.
Vydyne nylon resins, Heat Stabilization of Nylon 66, copyright 2002, Solutia, Inc.

* cited by examiner

GRILL TOOL, ASSOCIATED PAD, AND ASSOCIATED METHODS

RELATED APPLICATION

This application claims the benefit of the filing date of U.S. provisional application Ser. No. 61/044,454, filed Apr. 11, 2008, the disclosure of which is incorporated herein by reference.

FIELD

Aspects of embodiments and embodiments of the present invention generally relate to a grill tool, associated pad, and associated methods and, more particularly, to a high-temperature grill tool, associated pad, and associated methods.

BACKGROUND

Grill cleaning tools are desirable for cleaning grill surfaces, such as platen grills used in the quick-service restaurant industry. It is desirable for such grill cleaning tools to be capable of withstanding the operating temperature of the grill surface such that the grill can be cleaned while it is in operation.

Prior art grill cleaning tools and associated methods include the grill cleaning tool 10 shown in FIG. 1. The prior art tool includes grill tool handle 12, grill scrubber head 14, and pad 16. As shown in the Figure, the grill handle 12 is an elongated linear member that is attached to the scrubber head 12. The pad 16 is disposed only on the top and bottom of the scrubber head 12.

Cleaning a grill surface, such as a platen clamshell grill, can be a strenuous job. When the prior art grill cleaning tool 10 is used to clean a grill surface, it is difficult, if not impossible, for the operator to orient the grill tool 10 to clean the entire grill surface, such as the back and sides of the grill which may be at odd angles and/or in tight spaces. Particularly, the linear configuration of the grill tool handle 12 makes it difficult for the operator to orient the grill tool to reach the difficult-to-reach areas of the grill without the operator's hand touching the hot grill surface. Also, the configuration of the pad 16 on the head 14 inhibits the pad 16 from reaching those difficult areas of the grill because the pad 16 is disposed only on the top and bottom of the head 14, and not also on the sides and ends of the head 14.

It would therefore be desirable to provide a grill cleaning tool and associated pad that enables to the operator to orient the tool to efficiently and safely clean grill surfaces, such as platen grill surfaces.

It would also be desirable to provide a grill cleaning tool having a removable pad that enables the operator to quickly replace the pad on the grill cleaning tool.

SUMMARY

Aspects of embodiments and embodiments of the present invention meet these and other needs by providing, without limitation, a grill tool, a pad usable with the grill tool, and a method of making and using the grill tool. Advantageously, such a grill tool may be configured for cleaning a surface while maintaining the surface at a temperature up to the operating temperature of the surface. The grill tool may be capable of withstanding a temperature up to the operating temperature of the surface. The pad includes a material compatible with the grill tool. The material facilitates delivery of the grill tool to the surface to facilitate the cleaning of the soiled surface. As with the grill tool, the material is capable of withstanding a temperature up to the operating temperature during a cleaning of the soiled surface. In other aspects of embodiments, the operating temperature of the surface comprises up to about 232° C. (450° F.) or more.

Some aspects of embodiments and embodiments of the present invention are directed to a grill tool including a tool head and a tool handle. The tool head may include an attachment mechanism for removably attaching a cleaning pad to the head so as to present a major cleaning surface and minor cleaning surfaces some of which are opposite the major cleaning surface. The tool handle may be configured to include handles capable of maintaining a user's hands horizontally and vertically spaced apart along the handle. In some aspects, the grill tool may further include a cleaning pad. In one aspect, the cleaning pad may be any one of a metallic material, a polymeric material, a natural material, or combinations thereof. In another aspect, the cleaning pad may be any one of a woven material, a nonwoven material, or combinations thereof. In yet another aspect, the cleaning pad further may include an abrasive. In still yet another aspect, the cleaning pad further may include a cleaning composition.

Other aspects of embodiments and embodiments of the present invention are directed to a grill tool including a tool head and a tool handle. The tool head includes an attachment mechanism including a pivotable tensioner for removably attaching a cleaning pad to the head so as to present a major cleaning surface and minor cleaning surfaces some of which are opposite the major cleaning surface. The tool handle may be configured to include handles capable of maintaining a user's hands horizontally and vertically spaced apart along the handle.

In aspects of embodiments, the tool head of the grill tool includes a first head end, a second head end, a first surface, optionally substantially planar, and opposite surfaces. The first surface may be between the first and second head ends. The opposite surfaces may be opposite the first surface. Also, the opposite surfaces may include at least two substantially planar portions proximate to the first and second head ends. Further, between the first and second head ends may be a first coupling member for removably securing the tool head at a first end of the tool handle.

In other aspects of embodiments, the tool handle of the grill tool includes a first handle end, a second handle end, a middle handle portion, an extension handle portion, and a second end handle portion. The first handle end may have an end portion including a second coupling member complementary to the first coupling member and for removably securing the tool head at the first end of the handle. The middle handle portion may have a longitudinal axis that may extend upwardly and rearwardly at an angle from a plane of the first surface of the tool head. Also, the middle portion may have a first hand grip of the handle. The extension handle portion may intersect the middle handle portion and extend upwardly and rearwardly at a steeper angle than the middle handle portion. The second end handle portion may intersect the extension handle portion and extend downwardly and rearwardly to the second handle end, the second end handle portion having a second hand grip of the handle. In one aspect, the tool handle further may include a first end handle portion extending upwardly from the first end and intersecting the middle handle portion. In another aspect, the tool handle further may include a raised portion at an end of the first hand grip toward the tool head. Such raised portion may be configured to accommodate a biasing of a portion of hand there against. In yet another aspect, the first surface between the first and second head ends may be substantially planar. In still yet another aspect, the middle handle portion, extension handle portion, and second end handle portion may be contained in one plane.

Some aspects relate to the attachment mechanism that may include one or more pad engagement members. Other aspects relate to the pivotable tensioner of the attachment mechanism that may be at one of the first head end and the second head end of the tool head and the one or more pad engagement members that may be at the other of the first head end and the second head end of the tool head. In an aspect, that pivotable tensioner further may include one or more pad engagement members. In another aspect, the one or more pad engagement members may be a pin. In yet another aspect, the one or more pins further may include a one or more protrusions. In still yet another aspect, the attachment mechanism further may include a lock mechanism. In a further aspect, the lock mechanism may include a locking tab on one of the pivotable tensioner and the tool head.

In still yet other aspects of embodiments, the tool head may be made using a first material, the tool handle may be made using a second material, and the first material may be capable of withstanding a higher temperature than the second material. In one aspect, the first material and the second material may be injection moldable polymers. In another aspect, the injection moldable polymers may be any one of a thermoplastic polymer, a thermoset polymer, alloys thereof, copolymers thereof, mixtures thereof, composites thereof, or combinations thereof. In still other aspects, the injection moldable polymers may be any one of a polystyrene, acrylonitrile butadiene styrene (ABS), polyamide, polyolefin, alloys thereof, copolymers thereof, mixtures thereof, composites thereof, or combinations thereof. In still yet other aspects, first material may be a nylon, alloys thereof, copolymers thereof, mixtures thereof, composites thereof, or combinations thereof and the second material may be any of one of a polypropylene, polyethylene, polyvinyl chloride (PVC), alloys thereof, copolymers thereof, mixtures thereof, composites thereof, or combinations thereof.

Still yet other aspects of embodiments and embodiments of the present invention are directed to a grill tool for cleaning a surface while maintaining the surface up to the operating temperature of the surface. The grill tool includes a contoured handle and a tool head. The tool handle may be configured to include handles capable of maintaining a user's hands horizontally and vertically spaced apart along the handle. The tool head includes a first head end, a second head end, and a surface, optionally substantially planar, between the first and second head ends. Also the tool head may be removably, securely attached to the handle. Further, the tool head may be configured to receive a pad that may wrap around the tool head. In this manner, the pad may communicate with the surface and provide a cleaning surface on the first head end, second head end, therebetween surface, and a surface opposite the therebetween surface of the tool head.

In one aspect, the tool head may include a base portion and a pad attachment mechanism that may be pivotally attached to the base portion. In another aspect, the attachment mechanism may be a pivotable tensioner configured to wrap the pad around the tool head. In yet another aspect, the end of the base portion of the tool head opposite the pad attachment mechanism may include one or more pad engagement members on the top side of the base portion. In still yet another aspect, the pad attachment mechanism may include one or more pad engagement members. For example, the one or more pad engagement members may be configured to be in contacting communication with a pad. To that end, the one or more pad engagement members may be pins configured to be inserted into holes in a pad.

In still yet other aspects, the base portion of the tool head may taper in a direction from one of the first head end and second head end to the other of first head end and second head end so that the tool head is configured to be narrower than a pad at the tapered end so as to accommodate side cleaning surfaces.

And still yet other aspects of embodiments and/or embodiments of the present invention are directed to a method for making a grill tool for cleaning a surface while maintaining the surface up to the operating temperature of the surface. The method includes providing a contoured handle and providing a tool head. The tool head is capable of withstanding a temperature up to the operating temperature of the surface. The tool head includes a first head end, a second head end, and a surface, optionally substantially planar, between the first and second head ends. Also the tool head may be removably, securely attached to the handle. Further, the tool head may be configured to receive a pad that may wrap around the tool head. In this manner, the pad may communicate with the therebetween surface and provide a cleaning surface on the first head end, second head end, therebetween surface, and a surface opposite the therebetween surface of the tool head. In one aspect, the tool head and the tool handle may be attached in a removable manner or an non-removable manner (e.g., permanent snap fitting)

In one aspect, the providing may be injection molding. In another aspect, the injection molding may be injection molding using any one of a thermoplastic polymer, a thermoset polymer, alloys thereof, copolymers thereof, mixtures thereof, composites thereof, or combinations thereof. For example, injection molding may be injection molding using, without limitation, any one of a polystyrene, acrylonitrile butadiene styrene (ABS), polyamide, polyolefin, alloys thereof, copolymers thereof, mixtures thereof, composites thereof, or combinations thereof. In one aspect, the injection molding may involve using a nylon, alloys thereof, copolymers thereof, mixtures thereof, composites thereof, or combinations thereof for the tool head and any of one of a polypropylene, polyethylene, polyvinyl chloride (PVC), alloys thereof, copolymers thereof, mixtures thereof, composites thereof, or combinations thereof for the tool handle.

Accordingly, some aspects of embodiments and/or embodiments of the present invention are directed to a grill tool including a tool head and a tool handle. The tool head may include an attachment mechanism for removably attaching a cleaning pad to the head so as to present a major cleaning surface and minor cleaning surfaces, some of which are opposite the major cleaning surface. The tool handle may be configured to include handles capable of maintaining a user's hands horizontally and vertically spaced apart along the handle.

Other aspects of embodiments and/or embodiments of the present invention are directed to a grill tool including a tool head and a tool handle. The tool head includes an attachment mechanism including a pivotable tensioner for removably attaching a cleaning pad to the head so as to present a major cleaning surface and minor cleaning surfaces, some of which are opposite the major cleaning surface. The tool handle is configured to maintain a user's hands away from a grill surface while at the same time permitting a cleaning of a plurality of facing cooking surfaces.

Yet other aspects of embodiments and/or embodiments of the present invention are directed to a grill tool including a tool head, a tool handle, and, optionally, a cleaning pad. The tool head includes a first head end, a second head end, a first surface, optionally substantially planar, and opposite surfaces. The first surface may be between the first and second head ends. The opposite surfaces may be opposite the first surface. Also, the opposite surfaces may include at least two portions, optionally substantially planar, proximate to the first and second head ends of the tool head. Between the first and second head ends may be a first coupling member for removably securing the tool head at a first end of the tool handle. The tool handle may include a first handle end, a second handle end, a middle handle portion, an extension handle portion, and a second end handle portion. The first handle end may have an end portion including a second coupling member complementary to the first coupling member and for removably securing the tool head at the first end of the handle. The middle handle portion has a longitudinal axis that may extend upwardly and rearwardly at an angle from a plane of the first surface of the tool head. Also, the middle portion may have a first hand grip of the handle. The extension handle portion may intersect the middle handle portion and extending upwardly and rearwardly at a steeper angle than the middle handle portion. The second end handle portion may intersect the extension handle portion and extend downwardly and rearwardly to the second handle end. As with the middle portion, the second end handle portion may have a hand grip (e.g., second hand grip) on the handle. In an aspect, the second end handle portion may include a storing feature.

Still yet other aspects of embodiments and/or embodiments of the present invention are directed to a grill tool for cleaning a surface while maintaining the surface up to the operating temperature of the surface. The grill tool includes a contoured handle and a tool head. The tool head is capable of withstanding a temperature up to the operating temperature of the surface. The tool head includes a first head end, a second head end, and a surface, optionally substantially planar, between the first and second head ends. Also the tool head may be removably, securely attached to the handle. Further, the tool head may be configured to receive a pad that may wrap around the tool head. In this manner, the pad may communicate with the therebetween surface and provide a cleaning surface on the first head end, second head end, therebetween surface, and a surface opposite the therebetween surface of the tool head.

And still yet other aspects of embodiments and/or embodiments of the present invention are directed to a method for making a grill tool for cleaning a surface while maintaining the surface up to the operating temperature of the surface. The method includes providing a contoured handle and providing a tool head. The tool head is capable of withstanding a temperature up to the operating temperature of the surface. The tool head includes a first head end, a second head end, and a surface, optionally substantially planar, between the first and second head ends. Also the tool head may be removably, securely attached to the handle. Further, the tool head may be configured to receive a pad that may wrap around the tool head. In this manner, the pad may communicate with the therebetween surface and provide a cleaning surface on the first head end, second head end, therebetween surface, and a surface opposite the therebetween surface of the tool head. In one aspect, the tool head and the tool handle may be attached.

Still further aspects of embodiments and/or embodiments of the present invention are directed to grill tool for cleaning a surface including a handle and a tool head. In aspects, the handle may be configured to be capable of presenting at least a potion of a pad surface to a perimeter of a grill surface so as to be capable of cleaning the perimeter while at the same time the handle substantially remains within a footprint of the grill surface. In other aspects, the tool head that is attached to the handle may include an attachment mechanism configured to do one or more of (i) receive a pad that wraps around the tool head so that at least a portion is capable of communicating with the grill surface; (ii) provide one or more cleaning surfaces on one or more of a first head end, a second head end, a surface therebetween, a surface opposite the therebetween surface, or combinations thereof, (iii) be away from the one or more cleaning surfaces so as to permit an unobstructed communication between the one or more cleaning surfaces and the grill surface; or (iv) combinations thereof. In yet other aspects, the attachment mechanism may be configured so as to capable of presenting the one or more cleaning surfaces while at the same time being below the one or more cleaning surfaces.

Numerous other aspects of embodiments, embodiments, features, and advantages of the present invention will appear from the following detailed description and the accompanying drawings. In the description and/or the accompanying drawings, reference is made to exemplary aspects of embodiments and/or embodiments of the invention. Such aspects of embodiments and/or embodiments do not represent the full scope of the invention. Reference should therefore be made to the claims herein for interpreting the full scope of the invention. In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

These and other aspects, advantages, and salient features of the present invention will become apparent from the following detailed description, the accompanying drawings, and the appended claims.

DESCRIPTION

Figure 1:
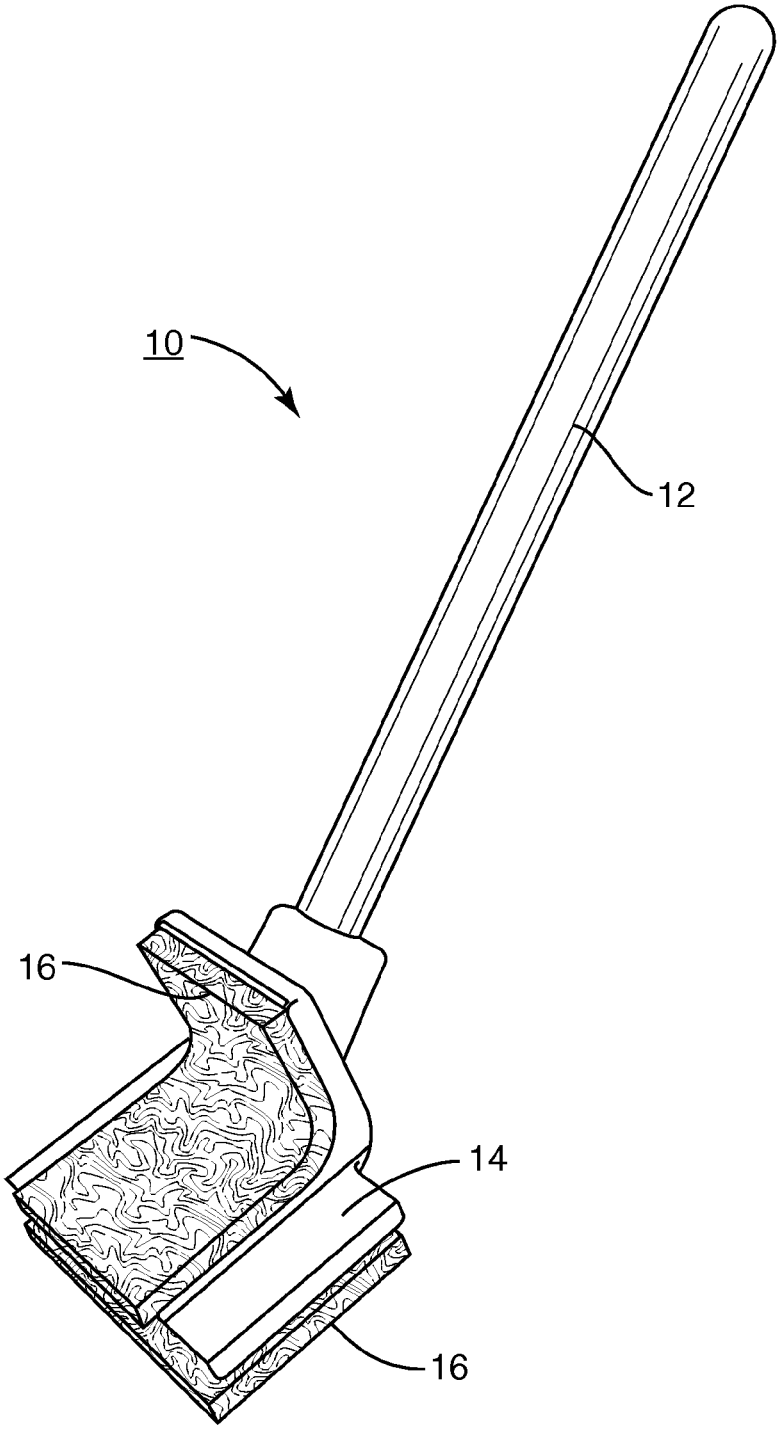
FIG. 1 PRIOR ART
FIG. 1 is a schematic drawing illustrating a perspective top view of a prior art grill tool.

In the following description, like reference characters designate like or corresponding parts throughout the several views. Also in the following description, it is to be understood that such terms as "forward," "rearward," "left," "right," "upwardly," "downwardly," "horizontal," "vertical," and the like are words of convenience and are not to be construed as limiting terms.

Referring now to the drawings in general, and FIGS. 2 through 13 in particular, it will be understood that the illustrations are for the purpose of describing one or more aspects of embodiments and/or embodiments of the invention and are not intended to limit the invention thereto.

FIGS. 2-13 schematically depict a grill tool 100 having a tool head 200 for accommodating a pad 300 for cleaning grill surfaces. As illustrated in FIGS. 2, 3, 4 and 6, the grill tool 100 may include a contoured handle 102. The rear portion of the handle 102 may provide a hand grip or hand location 102A for an operator to position his or her first hand on the handle 102 in a natural and comfortable position. A middle portion of the handle 102 may provide an additional hand grip or hand location 102C for the operator to position his or her second hand on the handle 102, also in a natural and comfortable position. A ridge 102D formed by an increased cross section of the handle 100 may provide a stopping mechanism to promote proper positioning of the operator's second hand and inhibit it from sliding down the handle 102 during use of the tool 100. Also, ridge 102D may accommodate a transfer of force from a hand to the tool 100.

Both the hand grip or hand location 102A and additional hand grip or hand location 102C may include increased texture in the material forming the handle 102, as discussed below, and may include a gradual increase in the cross section of the handle 102 where the respective hands may be positioned to further the comfort and stability of the operator's hands during use of the tool 100. Thus, placement of the operator's hand on the hand grip or location 102A and additional hand grip or location 102C, respectively, may enable the operator to gain leverage while using the tool 100 in a comfortable position. With regards to a texture, in FIGS. 2, 4, 5, and 12 at hand grip or hand location 102A and additional hand grip or hand location 102C ellipses shown for areas 104 including a texture portion for decreasing or stopping sliding. It will be appreciated that the textured areas 104 may be any shape. Further, it will be appreciated that the texture may be any that increases a gripping friction of an operator's hand on the tool.

Figure 3:
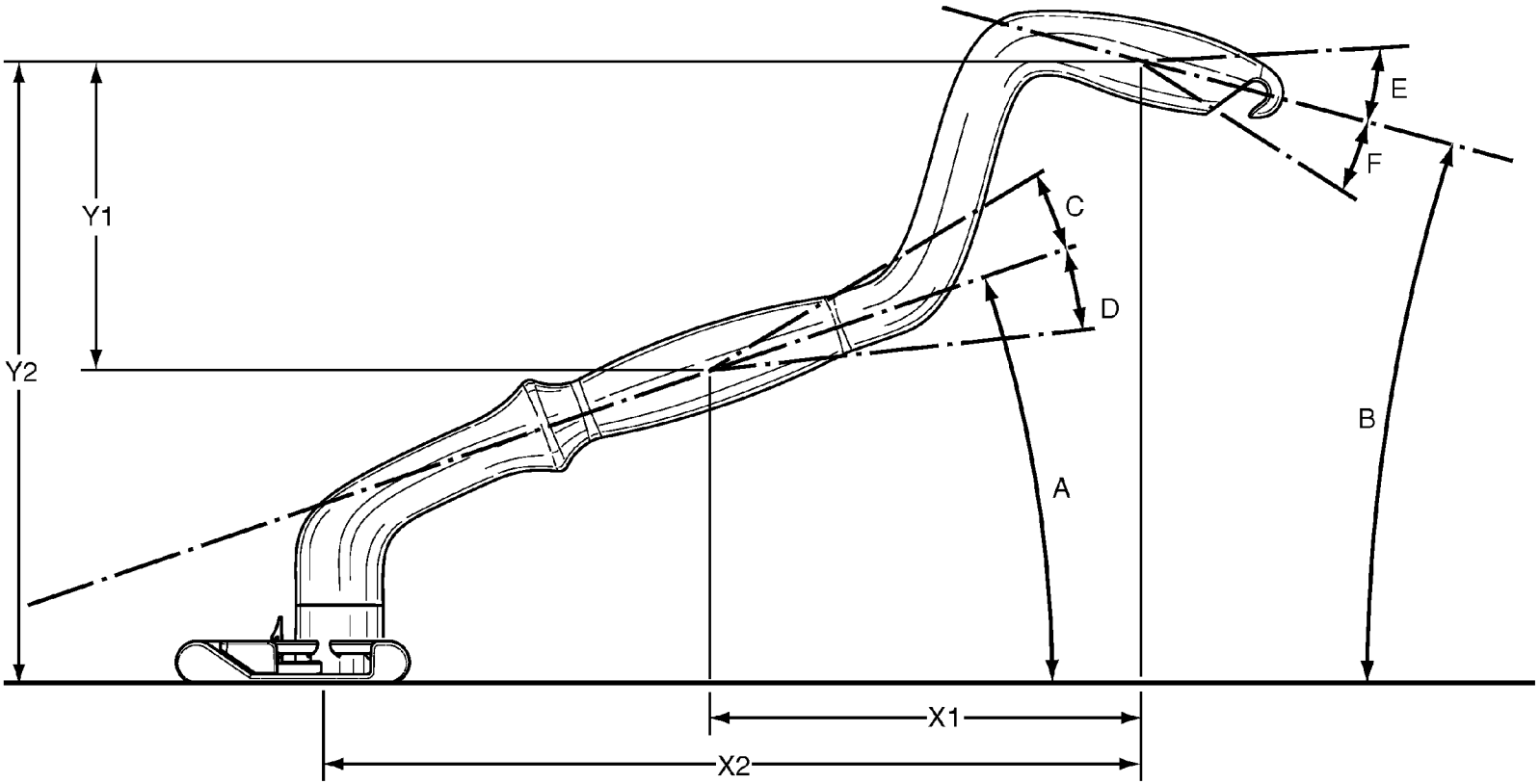
FIG. 3 is a schematic drawing illustrating a side view of the grill tool of FIG. 2 and the angles of contoured grill tool handle in accordance with an aspect of an embodiment of the present invention.

As shown in FIG. 3, the tool handle may be configured to include handles capable of maintaining a user's hands horizontally and vertically spaced apart along the handle. It has been found that to maintain an ability to obtain effective leverage during use of tool 100, a spacing of a center of mass of hand grip or location 102C and a center of mass of additional hand grip or location 102A falls within ranges that allow an effective use in cleaning the variety of surfaces that may be encountered on, for example, platen grills. To that end, in an aspect a horizontal spacing (X1) between the center of masses of hand grip or location 102C and additional hand grip or location 102A may range from about 6 inches to about 12 inches, in another aspect may range from about 6 inches to about 10 inches, and in yet another aspect, it may comprise about 7 inches. Likewise, in a further aspect a vertical spacing (Y1) between the center of masses of hand grip or location 102C and additional hand grip or location 102A may range from about 4 inches to about 10 inches, in yet a further aspect, it may range from about 4 inches to about 8 inches, and in still yet a further aspect may comprise about 5 inches. Further, it has been found that for a diverse variety of users to be able to effectively use tool 100, a vertical distance (Y2) from a plane of the tool head 200 to the center of mass of additional hand grip or location 102A may be maintained at predetermined value independent of the horizontal distance (X2) from substantially a center of the tool head 200 to the center of mass of additional hand grip or location 102A. To that end, the vertical distance (Y2) may range from about 9 inches to about 11 inches, in yet a further aspect it may range from about 9.5 inches to about 10.5 inches, and in still yet a further aspect it may comprise about 10 inches.

Angles that handle portions and/or hand grip or location 102C and/or additional hand grip or location 102A may improve the ergonomics of the grill tool 100 over prior art grill tools and, thereby, enable the operator to more comfortably and safely orient the grill tool 100 while cleaning grill surfaces at a variety of angles (e.g., a substantially horizontal grill surface, a downward facing upper grill surface, grill surface perimeters, . . . the like, or combinations thereof that may be encountered on for example platen grills). In one aspect, an angle "A" of a longitudinal axis of middle handle portion passing through the center of masses of the hand grip or location 102C with respect to a horizontal plane of major surface of the tool head 200 may be dependent upon the horizontal distance (X2) from substantially a center of the tool head 200 to the center of mass of additional hand grip or location 102A. For example, if horizontal distance (X2) is greater than about 13 inches, angle "A" may be less than about 19 degrees. In contrast, if horizontal distance (X2) is less that about 13 inches, angle "A" may be greater than about 19 degrees. In contrast, angle "B" of a longitudinal axis of second end handle portion passing through the center of masses of the hand grip or location 102A with respect to a horizontal plane of major surface of the tool head 200 may be independent at the horizontal distance (X2). However, in an aspect, angle "B" may range from about 12 degrees to about 18 degrees, in another aspect, angle "B" may range from about 13 degrees to about 17 degrees, and in another aspect, angle "B" may comprise about 15 degrees. It will be appreciated that a distance (X2) from tool head 200 to hand grip or location 102A may be varied so as to accommodate a dimension of a grill surface to be cleaned (e.g., for a shallower grill, the distance may be less than that for a deeper grill).

In further aspects, an angle "C" and an angle "D" at hand grip or location 102C indicate an amount that the longitudinal axis of hand grip or location 102C may be rotated about the center of mass of the hand grip or location 102C with respect a longitudinal axis of middle handle portion passing through the center of mass of the hand grip or location 102C. Angles "C" and an angle "D" may be the same or different and may range from up to about 5 degrees. In a similar manner in aspects, angle "E" and angle "F" at hand grip or location 102A indicate an amount that the longitudinal axis of hand grip or location 102A may be rotated about the center of mass of the hand grip or location 102A with respect to a longitudinal axis of second handle portion passing through the center of mass of the hand grip or location 102A. Angles "E" and an angle "F" may be the same or different and may range from up to about 5 degrees. It will be appreciated that in addition to rotating about the center of mass as described and shown in FIG. 3, the center of mass of hand grip or location 102C and/or hand grip or location 102C may be translated in any one or more directions of a three dimensional orthogonal coordinate system (e.g., Y, Y-, X, X-, Z, Z-, or combinations thereof). In alternative aspects of embodiments, the center of mass of hand grip or location 102C and/or hand grip or location 102C may be translated solely (i.e., without rotating about the center of mass as described and shown in FIG. 3) in any one or more directions of a three dimensional orthogonal coordinate system.

Figure 12:
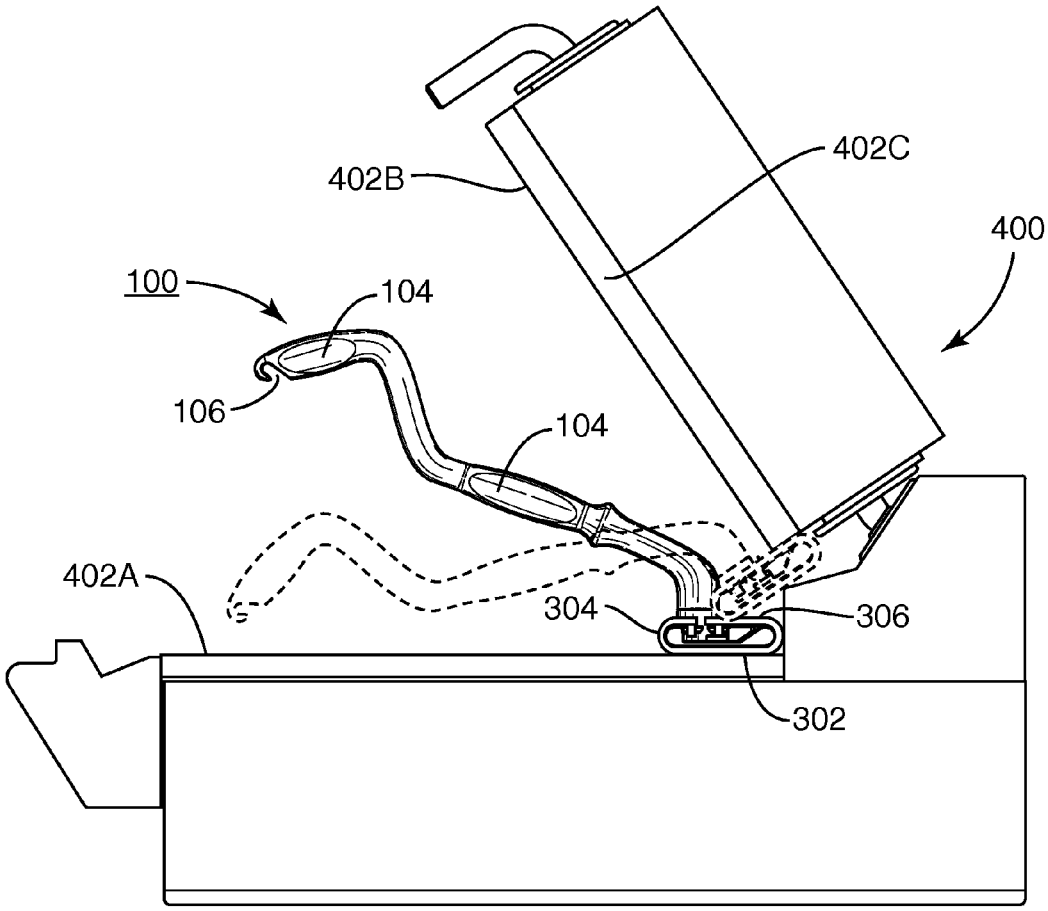
FIG. 12 is a schematic drawing illustrating a side view of the grill tool of FIG. 2 and how such grill tool may be oriented to clean the surface of a grill in accordance with an aspect of an embodiment of the present invention.

The above-described handle portions, hand locations, and angles of the contoured handle 102 may enable the operator to use the tool 100 in multiple orientations while diminishing the risk that the operator may inadvertently touch hot grill surfaces. For example, as shown in FIG. 12, the operator may tip the grill tool 100 either forward or backward without the handle 102 touching the grill surface 402A, 402B, and 402C.

Figure 11:
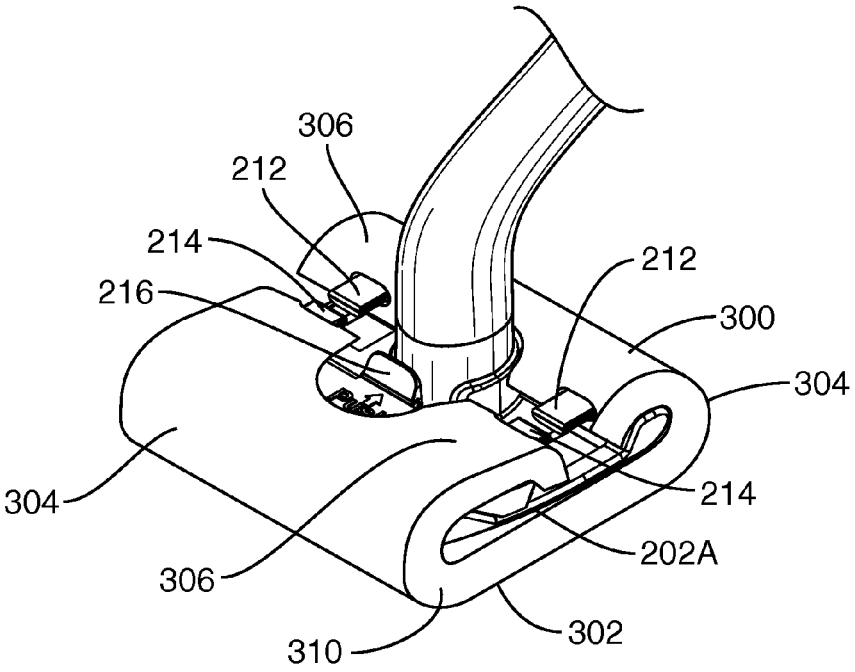
FIG. 11 is a schematic drawing illustrating a perspective view of the grill tool pad of FIG. 9 fully attached to the tool head of FIG. 2 in accordance with an aspect of an embodiment of the present invention.

Referring now to FIGS. 2 and 3-8, the grill tool 100 of the present invention may include a tool head 200 that may be securely, and in one aspect removably, attached to the handle 102. The head 200 may facilitate attachment of a cleaning pad 300 that may be wrapped around the head 200 to create a cleaning surface on the front, back, top, and bottom of the head 200, as described in more detail below. In an aspect, the shape and configuration of the tool head 200 may enable the pad 300 to provide cleaning surfaces on the sides 202A, 202B of the tool head 200 and thereby enable the tool 100 to reach grill surfaces that are at odd angles and that are in tight spaces. Particularly, the right and left sides of the tool head, 202A and 202B respectively, may be curved and angled such that the width of the front end 202C of the head 200 may be a smaller width than the width of the rear end 202D of the head 200. When a rectangular shaped pad 300 is attached to the head 200, the pad 300 may overhang the sides 202A, 202B of the head 200, as shown in FIG. 11. Thus, when the operator uses the side of the tool 100 to clean a grill surface, the curved and angled sides 202A, 202B of the head 200 may enable the flexure of pad 300 against the sides 202A, 202B of the head 200 to create an additional cleaning surface.

Figure 5:
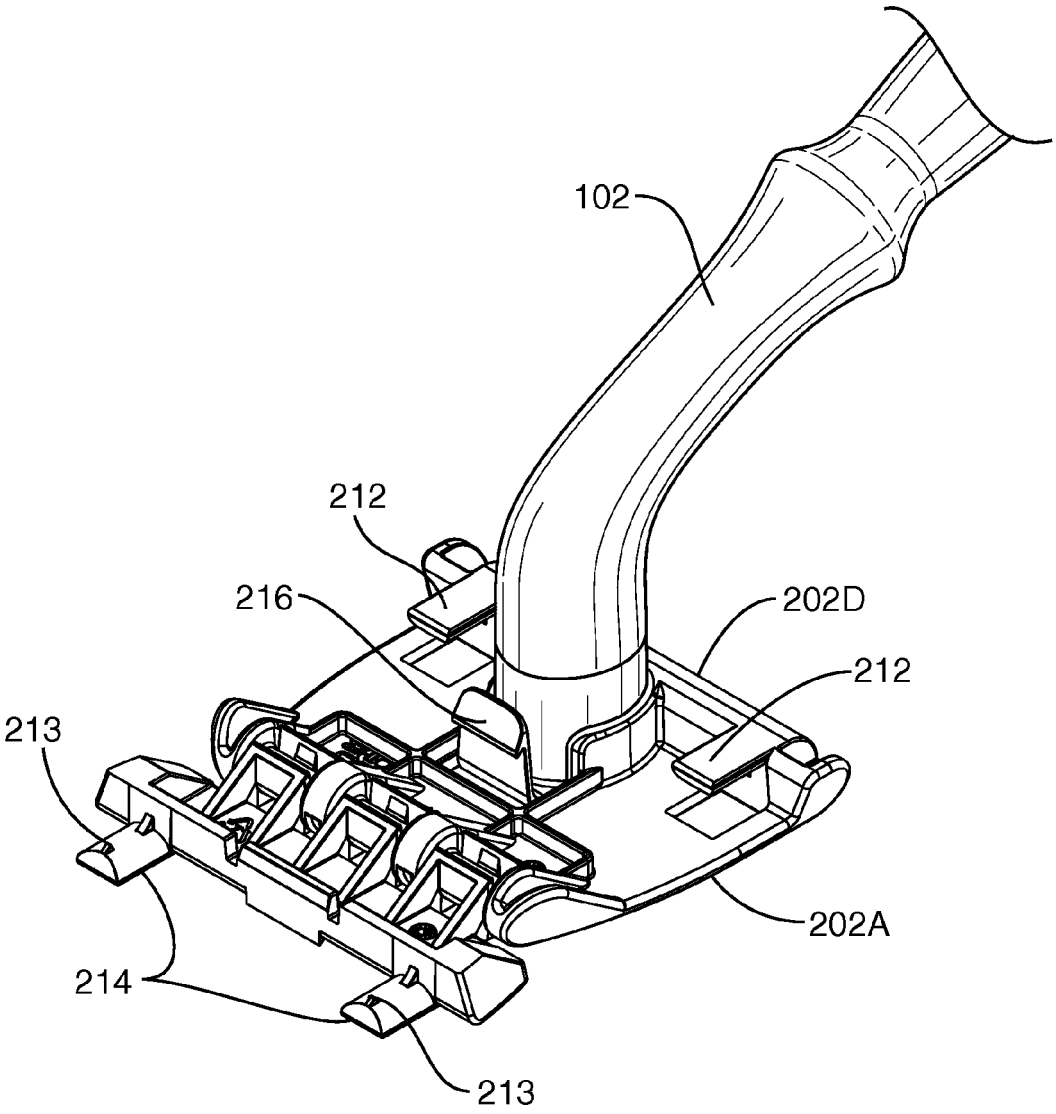
FIG. 5 is a schematic drawing illustrating a perspective top view of the tool head of FIG. 2 in an open position in accordance with an aspect of an embodiment of the present invention.
Figure 7:
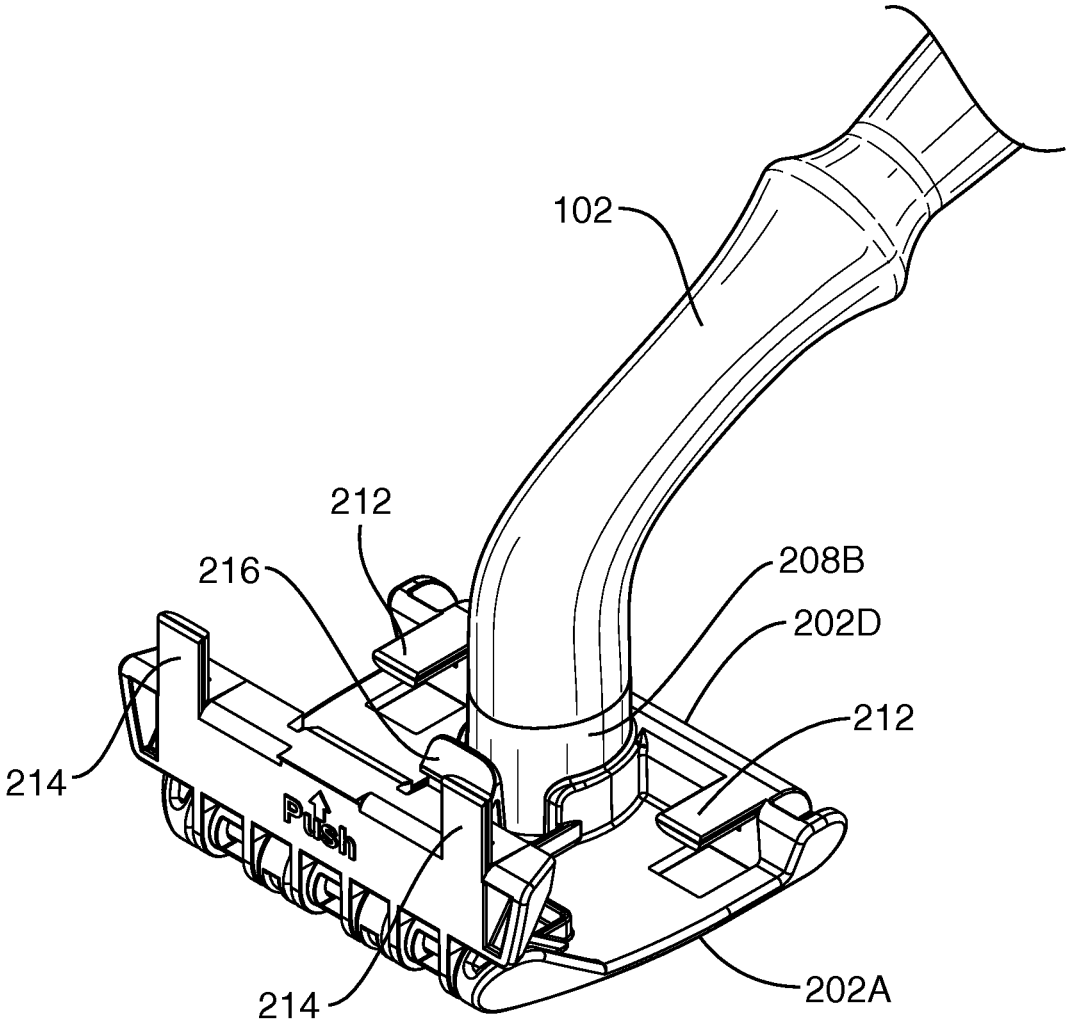
FIG. 7 is a schematic drawing illustrating a perspective top view of the grill tool of FIG. 2 with the tool head in a partially closed position in accordance with an aspect of an embodiment of the present invention.
Figure 8:
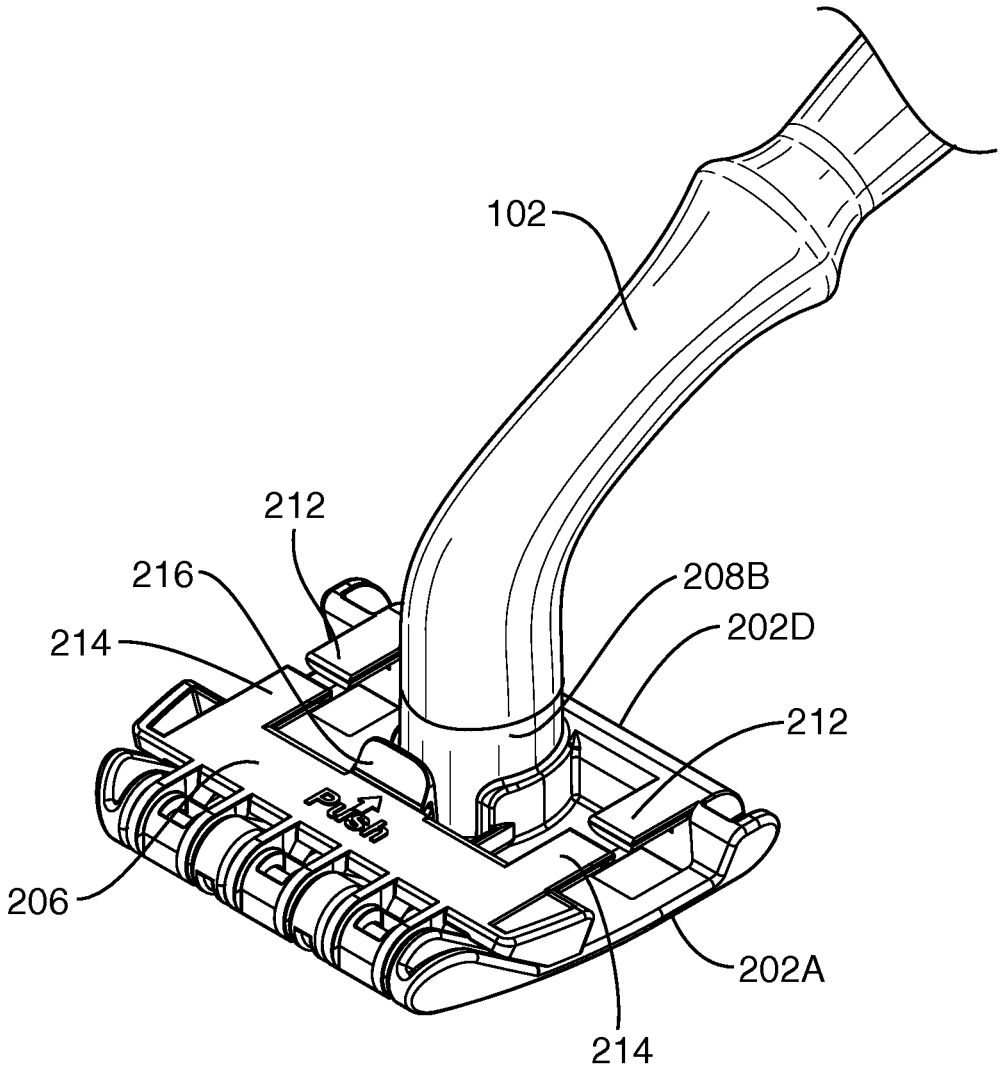
FIG. 8 is a schematic drawing illustrating a perspective view of the grill tool of FIG. 2 with the tool head in a closed position in accordance with an aspect of an embodiment of the present invention.

The tool head 200 may include a pad attachment mechanism 210 that, in an aspect, may be pivotally secured to one end of the base portion of the head 200, such as the front end 202C, to facilitate attachment of a pad 300 to the tool head 200. In one aspect of an embodiment of the invention, the method of attaching a pad 300 to the tool head 200 may include a hole and pin configuration. For example, the top surface of one end of the tool head 200, such as the rear end 202D, may include two pins 212 (one pin 212 on either side of the handle 102), as illustrated in FIGS. 5, 7, and 8. The pad attachment mechanism 210 may also include two pins 214, and the distance between the pins 212 and the distance between the pins 214 may be the same.

Figure 9:
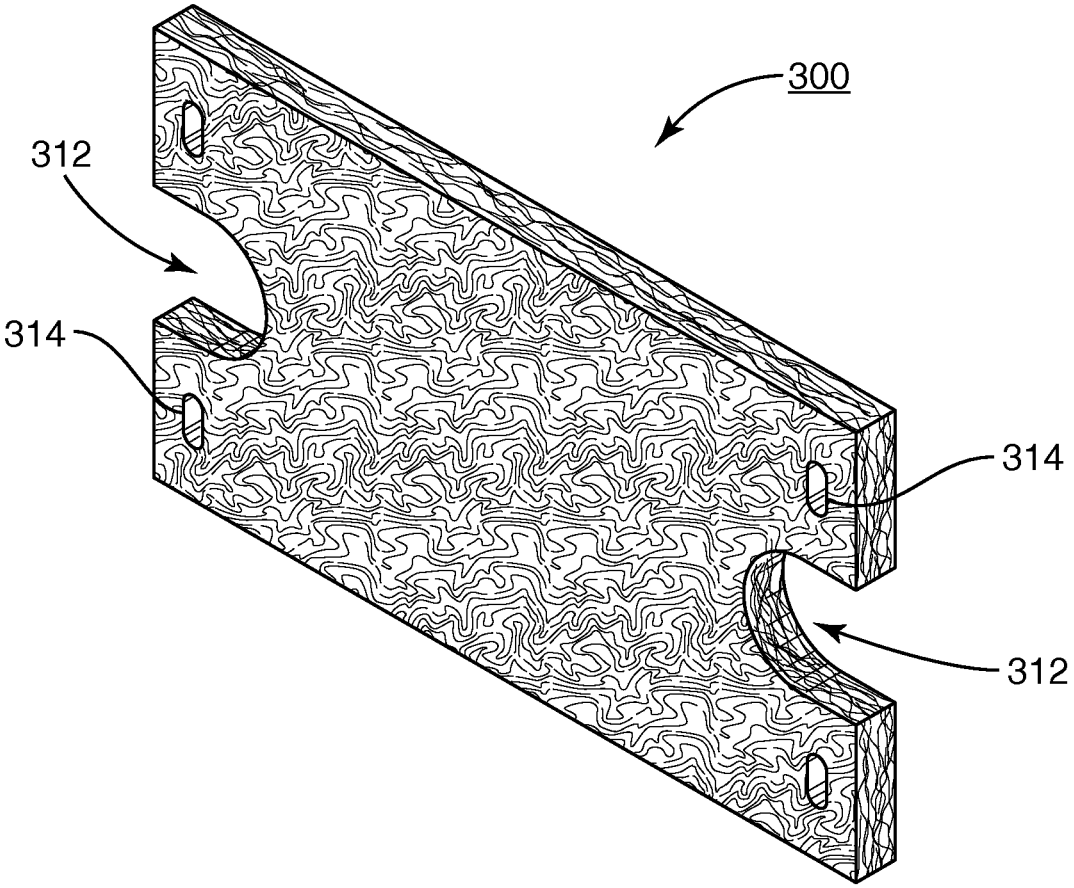
FIG. 9 is a schematic drawing illustrating a perspective view of a grill tool pad in accordance with an aspect of an embodiment of the present invention.

As illustrated in FIG. 9, the pad 300 may be flexible and may have a generally rectangular shape with semi-circular cut-outs 312 on each short end. The pad 300 may also include two hole cut-outs 314 on each short end of the pad 300. The distance between the holes 314 on each end of the pad 300 may be the same as the distance between the pins 212 and 214, respectively, on the tool head 200.

Figure 2:
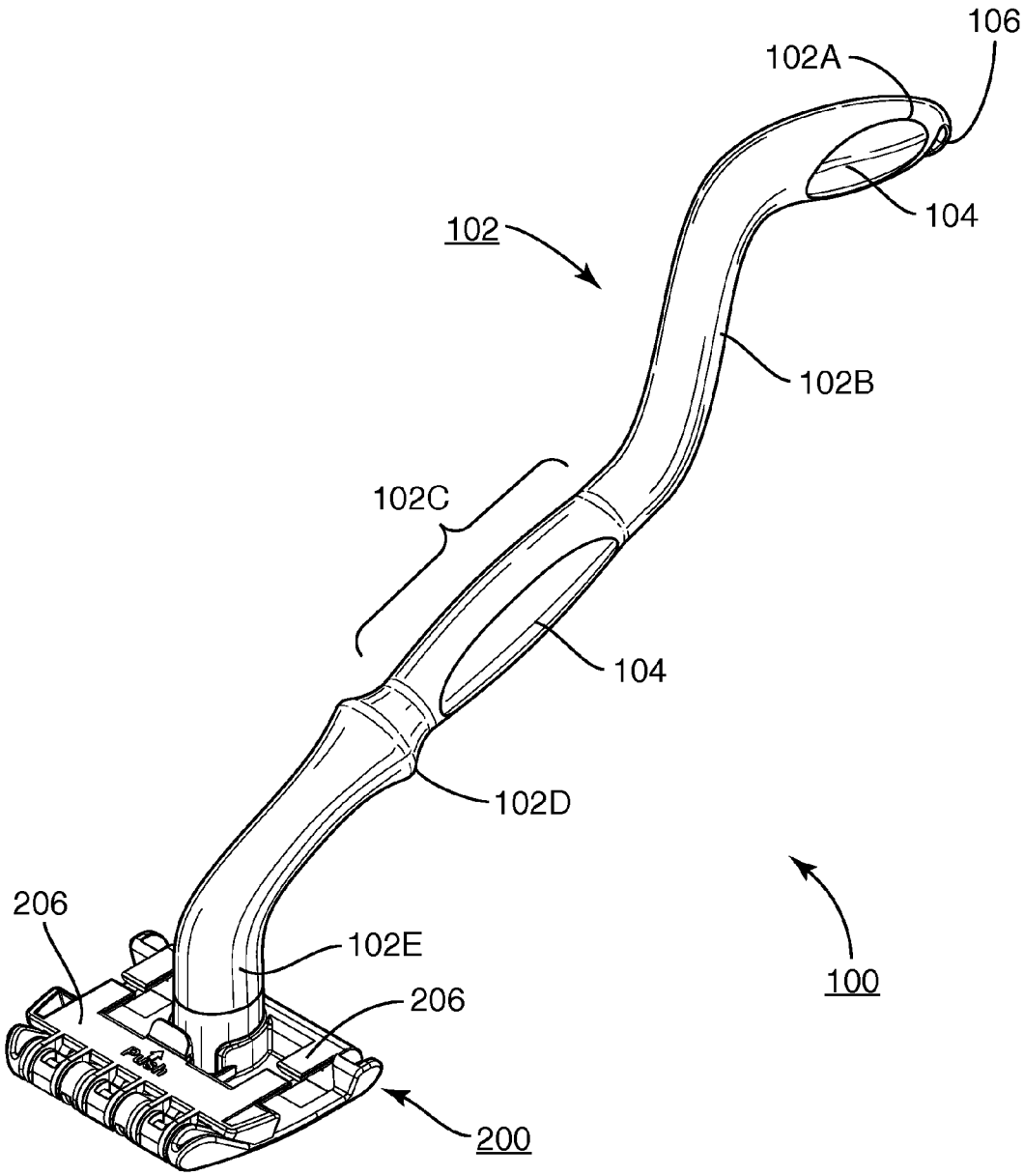
FIG. 2 is a schematic drawing illustrating a perspective left, top view of a grill tool with a tool head in a closed position in accordance with an aspect of an embodiment of the present invention.
Figure 4:
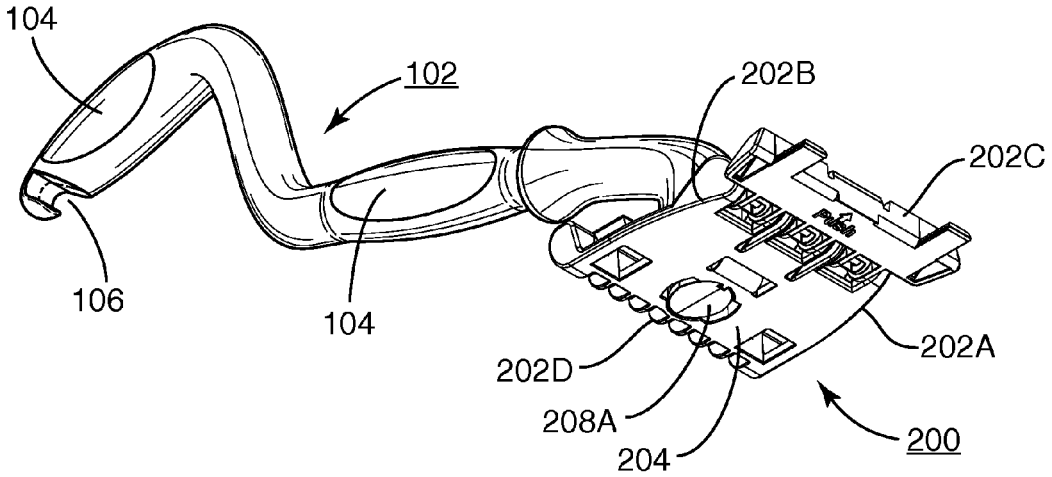
FIG. 4 is a schematic drawing illustrating a perspective bottom view of the grill tool of FIG. 2 with the tool head in an open position in accordance with an aspect of an embodiment of the present invention.
Figure 6:
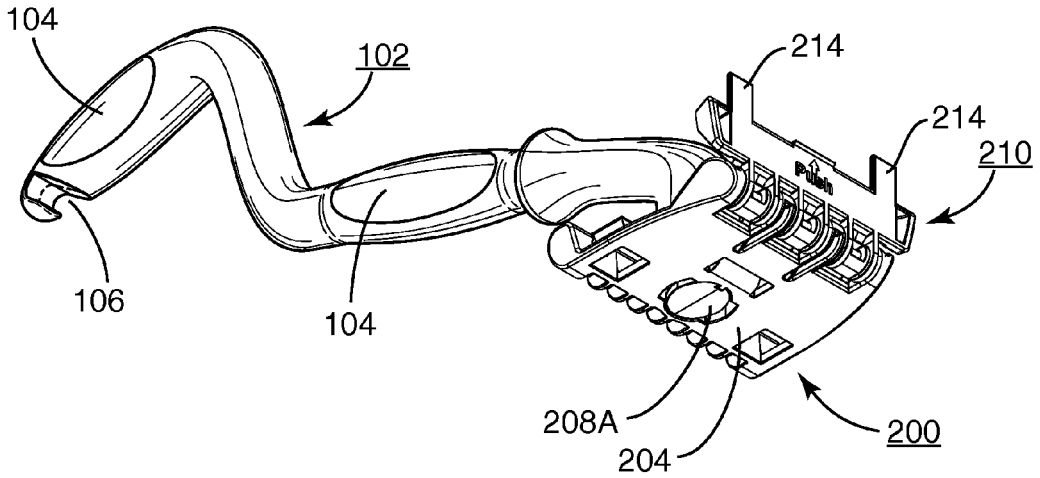
FIG. 6 is a schematic drawing illustrating a perspective bottom view of the grill tool of FIG. 2 with the tool head in a partially closed position accordance with an aspect of an embodiment of the present invention.
Figure 10:
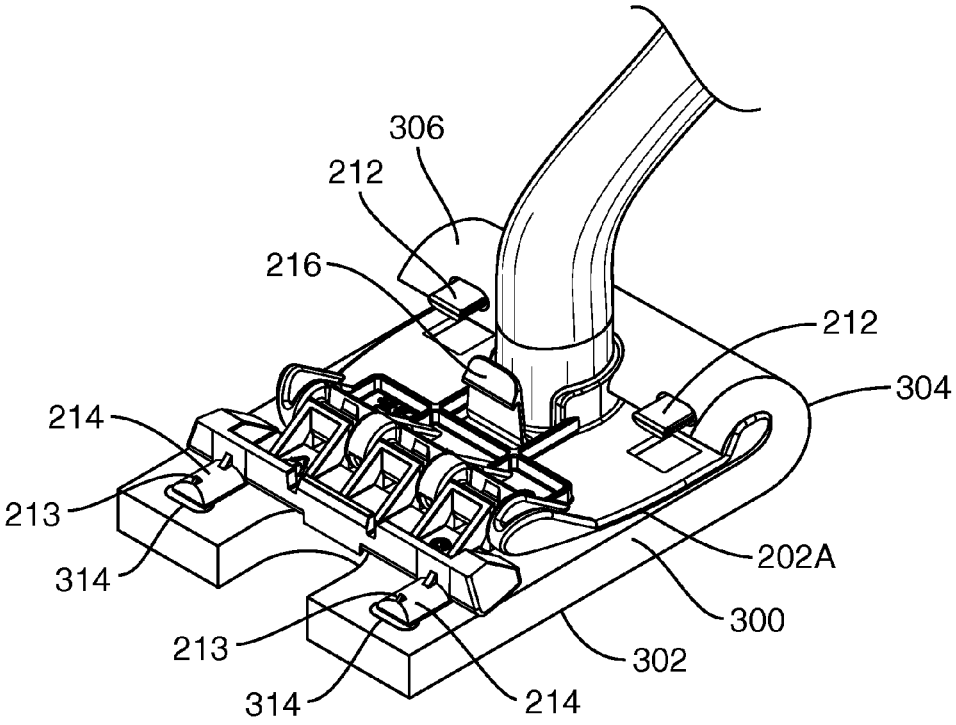
FIG. 10 is a schematic drawing illustrating a perspective view of the grill tool pad of FIG. 9 as partially attached to the tool head of FIG. 2 in accordance with an aspect of an embodiment of the present invention.

The pad attachment mechanism 210 may fluidly pivot from an open position, as shown in FIGS. 4 and 5, to a partially closed position, as shown in FIGS. 6 and 7, to a closed position, as shown in FIGS. 2 and 8. This pivoting mechanism 210 may facilitate easy and efficient attachment of the pad 300 to the head 200, and removal of the same. Particularly, when the pad attachment mechanism 210 is in an open position (e.g., which may range from about 130 degrees to 270 degrees although it may be sufficient to open just beyond about 130 degrees), the operator may be able to attach one end of the pad 300 to the head 200 by inserting the pins (either 212 or 214) into the holes 314 on one end of the pad 300, as shown in FIG. 10. The operator may then be able to attach the other end of the pad 300 to the head 200 by inserting the remaining set of pins (the other of 212 or 214) into the holes 314 on the other end of the pad 300. In order to secure the pad 300 to the head 200, the user may then pivot the pad attachment mechanism 210 to a closed position such that the pad 300 fully wraps around the head 200, as shown in FIG. 11. The action of pivoting the attachment mechanism 212 to a closed position (e.g., operating as a pivotable tensioner) may tighten the pad 300 as it securely wraps around the tool head 200 to create a four sided cleaning surface (e.g., first top, front, bottom, back, second top, the like, or combinations thereof). In an aspect, each of pins 212, 214 may include a protuberance 213 in the form of a small area raised above the level of the surrounding surface to create a seat for holes 314 of pad 300 to help hold the pad 300 in place while reducing or eliminating slipping during an attachment of the pad 300. In this manner, the pad 300 remains secured on the tool head 200 while loading.

In aspects of embodiments, the pad attachment mechanism 210 may be securely held in the closed position with a locking mechanism that includes a locking tab 216 that may extend upwardly from the tool head 200. Such locking tab 216 may include a ridge that prevents that pad attachment mechanism 210 from moving unless the locking tab 216 is physically pushed towards the handle 102 by the operator to release the locking tab 216 from placing pressure on the pad attachment mechanism 210. Thus, the locking tab 216 may be rigid enough of keep the pad attachment mechanism 210 from moving, yet flexible enough to enable it to be easily moved to release the pad attachment mechanism 210. By attaching a pad 300 to the tool head 200, as described above, the operator may be able to quickly secure the pad 300 to the head 200 and release the pad 300 only when desired.

The above-described grill tool 100, including a contoured handle 102, tool head 200, and a pad 300 that wraps around the head 200 to create multiple cleaning surfaces, may enable the operator to safely and comfortably orient the tool 100 to clean grill surfaces. In one aspect of an embodiment of the present invention, the operator may stroke the grill tool 100 back and forth on the grill surface to clean soil from the surface. In another aspect of an embodiment of the present invention, the operator may use the tool 100 to clean a clamshell platen grill 400, as illustrated in FIG. 12. Particularly, the operator may be able to clean the tight space where the top and bottom portions of the grill 400 are hinged. As mentioned above, the contoured handle 102 may enable the operator to tip the tool 100 back without touching the hot grill surfaces 402A, 402B. In the orientation shown in FIG. 12, the operator may stroke tool 100 back and forth on the surface 402A to clean soil from that surface. When an operator is to clean a soil from the intersection of the grill surface and the grill back (e.g., seen in the rounded gap in FIG. 12), the tool 100 may be rotated 90° about normal to the plane of the pad 300 from the orientation shown in FIG. 12 so that pad 300 is flush with the grill and back surfaces for a back and forth movement. Conveniently, although not shown, the operator may invert the tool 100 and stroke it back and forth on the surface 402B to clean soil from that surface. Again not shown, the operator also may easily clean the sides 402C of the grill 400 due to the pad 300 flexing over the sides 202A, 202B of the tool head 200 to provide an additional cleaning surface when the side of the tool 100 is used.

Figure 13:
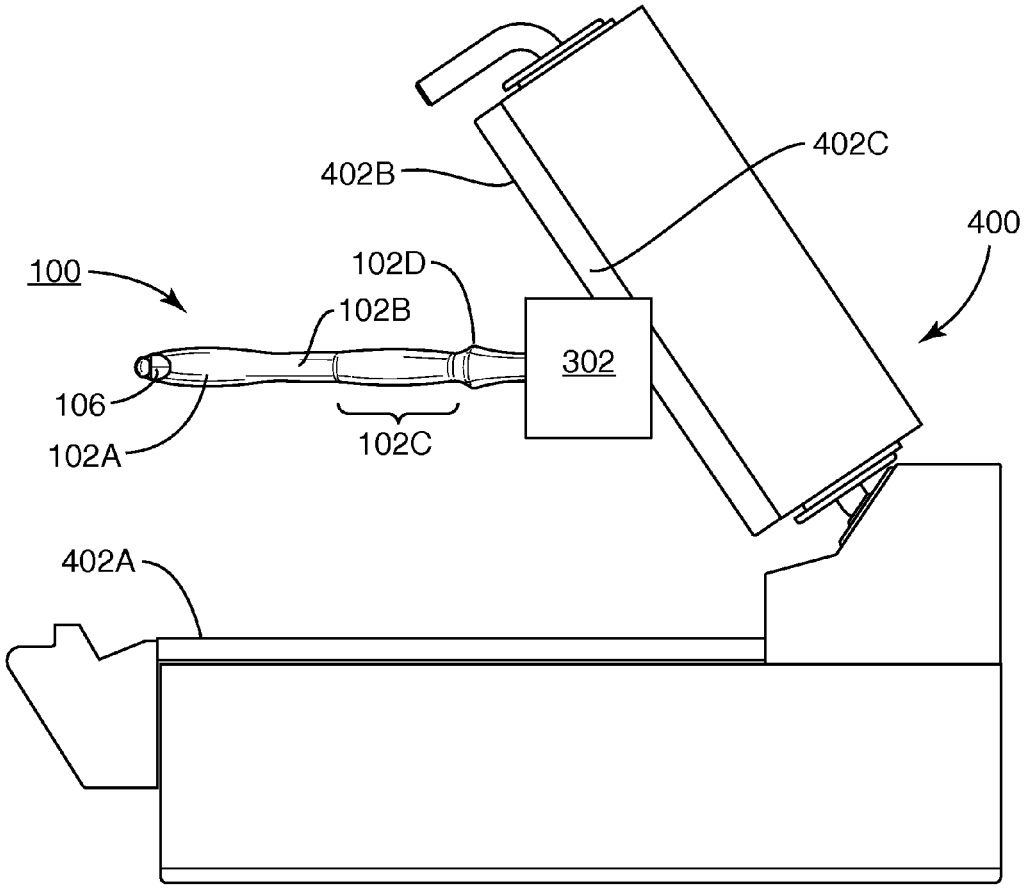
FIG. 13 is a schematic drawing illustrating a bottom view of the grill tool of FIG. 2 and other manners of how such grill tool may be oriented to clean the surface of a grill in accordance with an aspect of an embodiment of the present invention.

As shown in FIG. 13, in situations where the grill 400 is positioned next to a wall or other kitchen furniture so that a space between a side 402C and wall or other kitchen furniture, tool 100 may be oriented in a manner, for example, so that a top front and/or top back surface of pad 300 communicates with side 402C. It will be appreciated that these surfaces may be one of the left and/or the right. Then, operator may stroke it back and forth on the surface 402C to clean soil from that surface. An advantage in such situations is that the contoured handle 102 of tool 100 may be configured so as to be capable of being substantially maintained within a footprint of, on one instance, a grill surface, and, in another instance, within a footprint of an upper platen of a clamshell grill.

It should be understood that the grill tool handle 102 of the present invention may be formed of any durable material that may withstand the operating temperature of a grill surface.

It will be appreciated that the operating temperature of the grill surface may not be uniform. For example, the results of the testing of the Garland Xpress XG-24 double-sided griddle ("Garland Xpress XG-24 Double-Sided Griddle Performance Test" Food Service Technology Center, San Ramon, Calif., FSTC Report No. 5011.07.20, published December 2007, herein incorporated by reference, applying ASTM F1605-95 (2001) Standard Test Method for Performance of Double-Sided Griddles) show that the bottom grill surface, when set to maintain an average temperature of about 176° C. (350° F.), ranged from about 137° C. (280° F.) through about 182° C. (360° F.). Also for example, the results of the testing of the AccuTemp Accu-Steam EG2083A36 electric griddle ("AccuTemp Accu-Steam EG2083A36 Electric Griddle Performance Test" Food Service Technology Center, San Ramon, Calif., FSTC Report No. 5011.05.18, published December 2005, herein incorporated by reference, applying ASTM F1275-03 Standard Test Method for Performance of Griddles) show that the grill surface, when set to maintain an average temperature of about 190° C. (375° F.), ranged from about 187° C. (370° F.) through about 193° C. (380° F.). Furthermore, for example, the results of the testing of the Blodgett B36N TTT gas griddle ("Blodgett B36N-TTT Gas Griddle Performance Test" Food Service Technology Center, San Ramon, Calif., FSTC Report No. 5011.04.02, published August 2004, herein incorporated by reference, applying ASTM F1275-03 Standard Test Method for Performance of Griddles) show that the grill surface, when set to maintain an average temperature of about 190° C. (375° F.), ranged from about 137° C. (280° F.) through about 198° C. (390° F.). And yet further for example, the results of the testing of the Jade JGTSD gas griddle ("Jade JGTSD Gas Griddle Performance Test" Food Service Technology Center, San Ramon, Calif., FSTC Report No. 5011.03.18, published June 2003, herein incorporated by reference, applying ASTM F1275-03 Standard Test Method for Performance of Griddles) show that the grill surface, when set to maintain an average temperature of about 190° C. (375° F.), ranged from about 157° C. (315° F.) through about 201° C. (395° F.). Thus, in aspects of embodiments of the present invention, the operating temperature of the surface may comprise up to about 232° C. (450° F.) or more. In other aspects of embodiments of the present invention, the operating temperature of the surface may comprise from about 137° C. (280° F.) through about 232° C. (450° F.). In other aspects of embodiments of the present invention, the operating temperature of the surface may comprise from about 157° C. (315° F.) through about 221° C. (430° F.). In still yet other aspects of embodiments of the present invention, the operating temperature of the surface may comprise from about 171° C. (340° F.) through about 205° C. (400° F.).

In aspects of embodiments, the tool head may be made using a first material, the tool handle may be made using a second material, and the first material may be capable of withstanding a higher temperature than the second material. In one aspect, the first material and the second material may be injection moldable polymers. In another aspect, the injection moldable polymers may be any one of thermoplastic polymer, a thermoset polymer, alloys thereof, copolymers thereof, mixtures thereof, composites thereof, or combinations thereof. In still other aspects, the injection moldable polymers may be any one of a polystyrene, acrylonitrile butadiene styrene (ABS), polyamide, polyolefin, alloys thereof, copolymers thereof, mixtures thereof, composites thereof, or combinations thereof. In still yet other aspects, first material may be a nylon (e.g., nylon 6,6 and/or capable of withstanding a pH up to about 12.2 or more), alloys thereof, copolymers thereof, mixtures thereof, composites thereof, or combinations thereof and the second material may be any of one of a polypropylene, polyethylene, polyvinyl chloride (PVC), alloys thereof, copolymers thereof, mixtures thereof, composites thereof, or combinations thereof.

In aspects, the pad 300 may be any one of a metallic material, a polymeric material, a natural material, or combinations thereof. In another aspect, the pad 300 may be any one of a woven material, a nonwoven material, or combinations thereof. In yet another aspect, the pad 300 further may include an abrasive. To that end for example, a pad 300 may be a nonwoven material made using polyamide fibers (e.g., including, alloys thereof, copolymers thereof, mixtures thereof, composites thereof, or combinations thereof) bound with phenolic resin characterized to be any one of capable of not damaging or scratching grill surfaces, such as, nickel plated surfaces; suitable for use up to a temperature of about 232° C. (450° F.) or more; capable of use with caustic cleaning compositions (e.g., pH up to about 12.2 or more), . . . the like, or combinations thereof. Examples of materials that may be suitable for us as pads 300 include, without limitation, the line of cleaning products disclosed in the SCOTCH-BRITE™ cleaning products catalog dated 2004 from the 3M Commercial Care Division (St. Paul, Minn.) or the line of hand pad products disclosed in BEAR-TEX® surface finishing products section of the product catalog from the Saint-Gobain Abrasives, Inc. (Worcester, Mass.) or the line of hand pad products sold under the trade name BRITERITE™ from Standard Abrasives, Inc. (Simi Valley, Calif.). Such products may be die cut. In still yet another aspect, the pad 300 further may include cleaning composition.

The pad 300 may be a non-abrasive cleaning pad that is also capable of withstanding the operating temperature of a grill surface while it cleans the soiled surface. In one aspect of an embodiment of the present invention, the pad 300 may be about ½" thick. In an additional aspect of an embodiment, the pad may be formed of fine denier nylon fiber. In yet another aspect of an embodiment, the pad 300 may be cable of bending 180 degrees at about a 0.25" bend radius.

Other than in the operating examples, or where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by an aspect of an embodiment and/or embodiments of the present invention. At the very least, and not as an attempt to limit the application of the doctrine of equivalents to the scope of the claims, each numerical parameter should be construed in light of the number of significant digits and ordinary rounding approaches.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Several tests were conducted to determine how well a grill tool 100 made according to aspects of embodiments of the present invention might withstand the heat experienced in the cleaning of grill surfaces. More particularly, tests were conducted to determine how a tool head 200 of a grill tool 100 made according to aspects of embodiments of the present invention might withstand the heat experienced while cleaning a grill surface. In aspects, the grill tool is for cleaning grill surfaces, such as platen surfaces (e.g., including, without limitation, three platen grills as disclosed in U.S. Pat. No. 7,082,941, US 2006/0201495, US 2007/0254078, and US 2007/0251518) used in the quick-service restaurant industry. It has been observed that it can take up to about 45 minutes to clean such grill surfaces.

As a result, it could be desirable for the grill tool 100 to be resistant to incidental exposure to heat. The head 200 was molded from a polyamide 6/6 with a melting temperature of about 260° C. (500° F.) (see e.g., Vydyne® 21SPF/21SPG polyamide 66 resins Solutia Inc., St. Louis, Mo., USA) and a UL94 rating of V-2 (see e.g., UL 94, Tests for Flammability of Plastic Materials for Parts in Devices and Appliances Underwriters Laboratories Inc., <http://www.ides.com/property_descriptions/UL94.asp>, <http://www.firetesting.com/html/instruments/ul94ad.htm>, and <http://ulstandardsinfonet.ul.com/scopes/0094.html>). An ability to withstand high temperatures is an optional property in the selection of the handle 102 material. It is contemplated that even though the handle 102 might come in contact with a platen, it could be seldom. Thus, a polypropylene (see e.g., PRO-FAX™ 8523 super-high impact polypropylene copolymer resin, Lyondell Chemical Company, Rotterdam, The Netherlands) was selected for the handle 102 material.

Both of the selected materials were used in the previous version of the grill tool 10. The only recorded heat-related issue concerning grill tool 10 was that the small hook and loop attachments melted. As a result, grill tool 10 lost its ability to grip onto the cleaning pads over time. Because the attachments were thin, they were not able to provide resistance to the rated temperature for the polyamide 66 resins. Thin features were avoided in the design of the grill tool 100.

Different Incidental Contact tests were conducted to determine how well the grill tool 100 would perform under thermal stress. These tests examined how the first surface 204 of the tool head 200, first or front end 202C of the tool head 200, and bottom of the first coupling member 208A of the handle 102 (see e.g., surface contacted by the line from item number 208A in FIG. 4 and FIG. 6) withstood incidental contact of with a heated surface. Further details are given in the following sections.

The goal of the Incidental Contact tests was to study the effect of a brief period of contact of a specific area of a grill tool 100 with a hot surface on the grill tool 100. The specific areas were contacted for 30 seconds against a hotplate surface (Model #731, Cole-Parmer Instrument Co., Chicago, Ill., 04644 series digital hot plate/stirrer) heated to 232° C. (450° F.). The specific areas contacted against the heated hotplate were the first surface 204 of the tool head 200, first or front end 202C of the tool head 200, and bottom of the first coupling member 208A of the handle 102 (see e.g., surface contacted by the line from item number 208A in FIG. 4 and FIG. 6). Once cooled, each grill tool 100 was evaluated by first loading it in compression followed by drop testing. Each grill tool 100 was loaded in compression by manually applying a downward force to the handle 102 while the first or front end 202C of the tool head 200 rested on a surface. Then, using the same orientation, each grill tool 100 was dropped by hand three times from a height of approximately four feet. Each grill tool 100 was finally examined for any cracking, deforming, or other heat induced effects.

Several grill tools 100 were tested in different orientations at 232° C. (450° F.) for 30 seconds each. In the first orientation, three grill tool 100s were tested so that the first surface 204 of the tool head 200 was flat against the hotplate surface. The heat was enough to slightly melt the gate vestige of the polypropylene handle 102. Other than that, heat effects were minimal. The grill tools 100 all passed the compression tests. Only one grill tool 100 did not pass the drop test. Upon impact, the handle 102 broke in two places: the bottom surface of the handle 102 and part of the first coupling member 208A (see e.g., surface contacted by the line from item number 208A in FIG. 4 and FIG. 6). In the second orientation, two grill tool 100s were tested so that the first or front end 202C of the tool head 200 was rested against the hotplate surface. There were no noticeable effects caused by the exposure to heat. Both grill tools 100 passed the compression and drop tests. The final orientation was to rest the handle 102 of one grill tool 100 on a hotplate surface. The handle 102 was noticeably melted at the area of contact.

While typical aspects of embodiment and/or embodiments have been set forth for the purpose of illustration, the foregoing description and the accompanying drawings should not be deemed to be a limitation on the scope of the invention. Accordingly, various modifications, adaptations, and alternatives may occur to one skilled in the art without departing from the spirit and scope of the present invention. By way of example, the pivotable tensioner 211 of attachment mechanism 210 may be on one of the back end 202D or the front end 202C of tool head 200 and the tool head pins 212 may be on the other of the back end 202D and the front end 202C of tool head 200. Alternatively, the attachment mechanism 210 may include a pivotable tensioner at each of the back end 202D and the front end 202C of tool head 200. In a further variation, the attachment mechanism 210 may be on one or more of the sides rather than the front and/or back. Also, locking mechanism 216, rather than being a locking tab as illustrated in Figures and called out in FIGS. 5, 7, 8, and 10, may be a turning mechanism. It will be appreciated that any type of locking mechanism 216 that securely attaches a pad 300 to the tool head 200 while at the same time not interfering with an ability of the cleaning or working surfaces (e.g., first top, front, bottom, back, second top, . . . the like, or combinations thereof) of the pad 300 to communicate with the surfaces 403A, 403B, 403C of the grill to be cleaned. Further, it will be appreciated that the tool head 200 may be removably secured to the tool handle 102. In such instance alternative heads for different tasks (e.g., without limitation, a squeegee head, a scraper head, . . . the like, or combinations thereof) may be provided for interchangeably, securably attaching the to the tool handle 102. Also, one or more safety interlock features may be included to assure that a tool 100 dedicated to food preparation and/or food preparation equipment maintenance remains so.

It should be understood that all such modifications and improvements have been deleted herein for the sake of conciseness and readability but are properly within the scope of the following claims.

Item Numbers

100 grill tool
102 handle
102A second hand grip or location of second end handle portion
102A' second end handle portion
102B extension handle portion
102C first hand grip or location of a middle handle portion
102C' middle handle portion
102D handle ridge or raised portion
102E first end handle portion
104 texture area or region
106 storing feature
200 tool head
202A side of tool head
202B side of tool head
202C first or front end of tool head
202D second or rear end of tool head
204 first surface
206 opposite surfaces
208A first coupling member
208B second coupling member
210 attachment mechanism
211 pivotable tensioner
212 tool head pins
213 protuberance
214 attachment mechanism pins
216 locking mechanism (e.g., locking tab)
300 pad
302 major cleaning surface
304 minor cleaning surfaces
306 minor cleaning surfaces
310 minor cleaning surfaces
312 cut-outs (e.g., semi-circular cut-outs)
314 holes
400 clamshell platen grill
402A platen grill surface or grill plate surface
402B platen grill surface or grill plate surface
402C side of platen grill

The invention claimed is:

1. A grill tool comprising a tool head and a handle:

(A) the tool head comprising
- i. a first head end;
- ii. a second head end;
- iii. a first surface between the first and second head ends; and
- iv. surfaces opposite the first surface including at least two portions, optionally substantially planar, proximate to the first and second head ends and therebetween a first coupling member for removably securing the tool head at a first end of the tool handle; and wherein the tool head further comprises an attachment mechanism including a pivotable tensioner for removably attaching a cleaning pad to the head so as to present a major cleaning surface and opposite minor cleaning surfaces, and (B) the tool handle configured to include handles capable of maintaining a user's hands horizontally and vertically spaced apart along the handle, comprising:
- i. a first handle end having an end portion including a second coupling member complementary to the first coupling member and for removably securing the tool head at the first end of the handle;
- ii. a second handle end;
- iii. a middle handle portion extending upwardly and rearwardly at an angle from a plane of the first surface of the tool head, the middle portion having a first hand grip of the handle;
- iv. an extension handle portion intersecting the middle handle portion and extending upwardly and rearwardly at a steeper angle than the middle handle portion; and
- v. a second end handle portion intersecting the extension handle portion and extending downwardly and rearwardly to the second handle end, the second end handle portion having a second hand grip of the handle, and a first end handle portion extending upwardly from the first end and intersects the middle handle portion.

2. A grill tool according to claim 1, wherein the attachment mechanism further comprises one or more pad engagement members.

3. A grill tool according to claim 2, wherein the pivotable tensioner of the attachment mechanism is at one of the first head end and the second head end of the tool head and the one or more pad engagement members are the other of the first head end and the second head end of the tool head.

4. A grill tool according to claim 3, wherein the pivotable tensioner further comprises one or more pad engagement members.

5. A grill tool according to claim 4, wherein the one or more pad engagement members comprise a pin.

6. A grill tool for cleaning a surface while maintaining the surface up to the operating temperature of the surface, the grill tool comprising:
- a. a contoured handle; and
- b. a tool head capable of withstanding a temperature up to the operating temperature of the surface, the tool head removably, securely attached to the handle, the tool head comprising:
  - i. a first head end,
  - ii. a second head end, and
  - iii. a surface between the first and second head ends, wherein the tool head is configured to receive a pad that wraps around the tool head to communicate with the therebetween surface and provide a cleaning surface on the first head end, second head end, therebetween surface, and a surface opposite the therebetween surface of the tool head, wherein the tool head comprises a base portion and a pad attachment mechanism that is pivotally attached to the base portion the attachment mechanism comprises a pivotable tensioner configured to wrap the pad around the tool head wherein the end of the base portion of the tool head opposite the pad attachment mechanism includes one or more pad engagement members on the top side of the base portion.

7. The grill tool according to claim 6, wherein the pad attachment mechanism includes one or more pad engagement members.

8. The grill tool according to claim 7, wherein the one or more pad engagement members are configured to be in contacting communication with a pad.

9. The grill tool according to claim 7, wherein the one or more pad engagement members comprise pins configured to be inserted into holes in a pad.

10. The grill tool according to claim 9, wherein one or more pins further comprise a protuberance.

* * * * *